US006951474B1

(12) United States Patent
Wu

(10) Patent No.: US 6,951,474 B1
(45) Date of Patent: Oct. 4, 2005

(54) CABLE END CONNECTOR ASSEMBLY HAVING PULLING DEVICE

(75) Inventor: Jerry Wu, Irvine, CA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/898,414

(22) Filed: Jul. 22, 2004

(51) Int. Cl.[7] ..... H01R 13/627
(52) U.S. Cl. ..... 439/358
(58) Field of Search ..... 439/352–358

(56) References Cited

U.S. PATENT DOCUMENTS 5,230,636 A * 7/1993 Masuda et al. ..... 439/358
5,405,269 A * 4/1995 Stupecky ..... 439/191
5,826,813 A * 10/1998 Hibata ..... 242/383.1
6,565,383 B1 5/2003 Wu
6,585,536 B1 7/2003 Wu
6,585,537 B1 7/2003 Lee
6,655,979 B1 12/2003 Lee
6,692,285 B2 * 2/2004 Islam ..... 439/352

* cited by examiner

*Primary Examiner*—Truc Nguyen
(74) *Attorney, Agent, or Firm*—Wei Te Chung

(57) ABSTRACT

A cable end connector assembly (1) includes an insulative housing (2), a plurality of contacts (3) received in the housing, a plurality of wires (5) terminated to the contacts, a cover (6) over-molded with portions of the housing and the cable, a locking member (7) slideably assembled to the cover and the housing, and a pulling device (8). The locking member includes a pair of latch portions (720) for latching with a complementary connector and an oblique portion (722). The pulling device includes an acting portion (819) engaging with the oblique portion of the locking member, and a handling portion (82) at a rear end thereof. When the pulling device is rearwardly pulled, the oblique portion moves downwardly and rearwardly and deflects the latch portions to unlock from the complementary connector.

16 Claims, 9 Drawing Sheets

CABLE END CONNECTOR ASSEMBLY HAVING PULLING DEVICE

CROSS-REFERENCE TO RELATED APPLICATIONS

This application is related to U.S. patent application Ser. No. 10/776,111 filed on Feb. 10, 2004 and entitled "CABLE END CONNECTOR ASSEMBLY HAVING LOCKING MEMBER", and U.S. patent application Ser. No. 10/797,979 filed on Mar. 10, 2004 and entitled "CABLE END CONNECTOR ASSEMBLY HAVING LOCKING MEMBER", both of which have the same applicant and assignee as the present invention. The disclosure of these related applications is incorporated herein by reference.

BACKGROUND OF THE INVENTION

1. Field of the Invention

The present invention generally relates to a cable end connector assembly, and more particularly to a cable end connector assembly having a pulling device.

2. Description of Prior Art

There exits in the art an electrical connector known as a serial Advanced Technology Attachment (serial ATA) connector which is generally used for disk drives and storage peripherals. Especially, the serial ATA connector according to the serial ATA standard are featured in fewer electrical contacts than other conventional electrical connectors and are relatively tiny in configuration.

Generally, the serial ATA connector provides a latch means for providing a reliable mechanical and electrical connection with a complementary connector. U.S. Pat. Nos. 6,655,979 and 6,585,536, having the same assignee with the present invention, each disclose a serial ATA cable end connector assembly having a plurality of horizontally extending wires and a locking member for locking with a complementary connector. The locking member comprises a middle portion retained on a housing, a pressing portion extending rearwardly from the middle portion, and a locking portion extending forwardly from the middle portion for locking/unlocking the serial ATA connector with/from the complementary connector. However, in a situation where the plurality of wires of the cable end connector assembly disposed near the locking member extend in a direction perpendicular to or angular with a mating direction of the cable end connector assembly, when attempting to separated the cable end connector assembly from the complementary connector, it is inconvenient or even difficult for a user to hold the cable end connector assembly and operate the locking member in the direction perpendicular to the mating direction.

Hence, an electrical connector having an additional pulling device is desired to overcome the disadvantages of the prior art.

BRIEF SUMMARY OF THE INVENTION

Accordingly, the object of the present invention is to provide a cable end connector assembly having a pulling device for detaching the cable end connector assembly from a complementary connector more conveniently when a plurality of vertical or angularly extending wires are included with the cable end connector assembly.

In order to achieve the above-mentioned object, a cable end connector assembly in accordance with the present invention includes an insulative housing, a plurality of contacts received in the housing, a plurality of wires terminated to the contacts, a cover over-molded with portions of the housing and the cable, a locking member slideably assembled to the cover and the housing, and a pulling device for facilitating operation of the locking member. The locking member includes a pair of latch portions for latching with a complementary connector and an oblique portion. The pulling device includes an acting portion engaging with the oblique portion of the locking member and a handling portion at a rear end thereof. When the pulling device is rearwardly pulled, the oblique portion moves downwardly and rearwardly and deflects the latch portions to unlock from the complementary connector.

Other objects, advantages and novel features of the invention will become more apparent from the following detailed description of the present embodiment when taken in conjunction with the accompanying drawings.

DETAILED DESCRIPTION OF THE INVENTION

Figure 1:
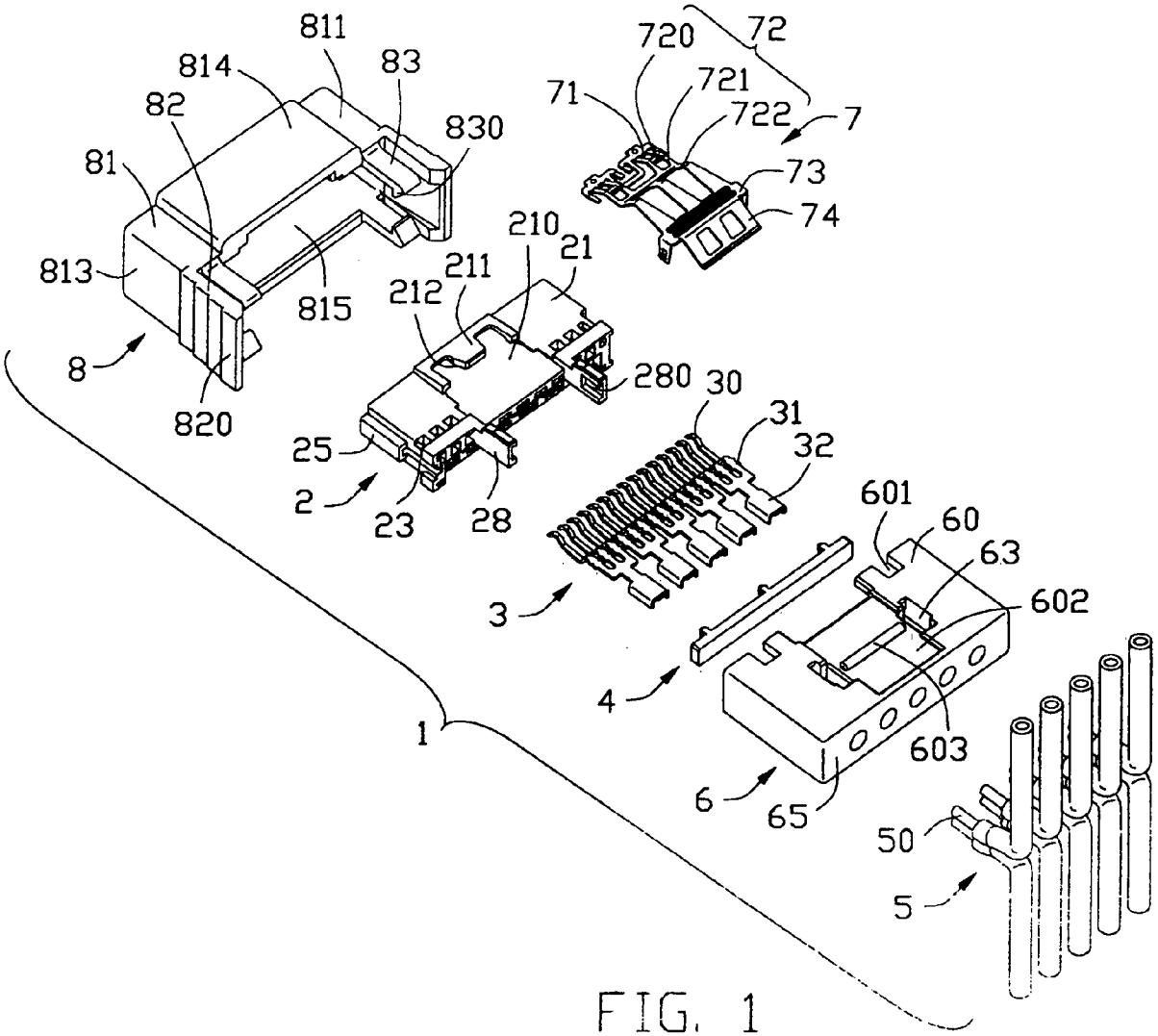
FIG. 1 is an exploded, perspective view of a cable end connector assembly in accordance with the present invention.

Reference will now be made to the drawing figures to describe the present invention in detail.

Figure 2:
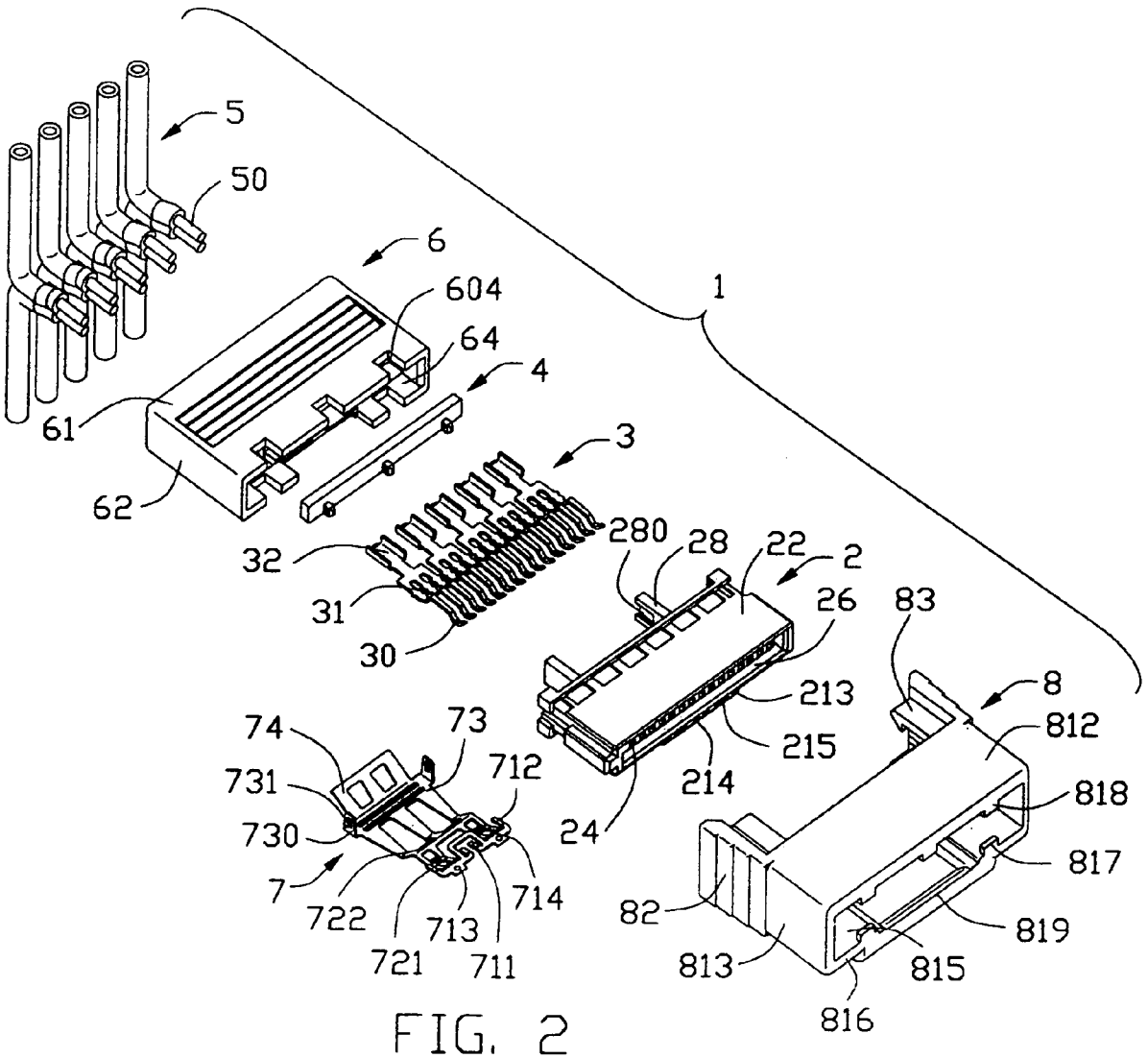
FIG. 2 is a view similar to FIG. 1, but taken from a different aspect.

Referring to FIGS. 1 and 2, a cable end connector assembly 1 in accordance with the present invention comprises an insulative housing 2, a plurality of contacts 3, a spacer 4, a plurality of wires 5, an insulative cover 6, a locking member 7 and a pulling device 8.

Figure 6:
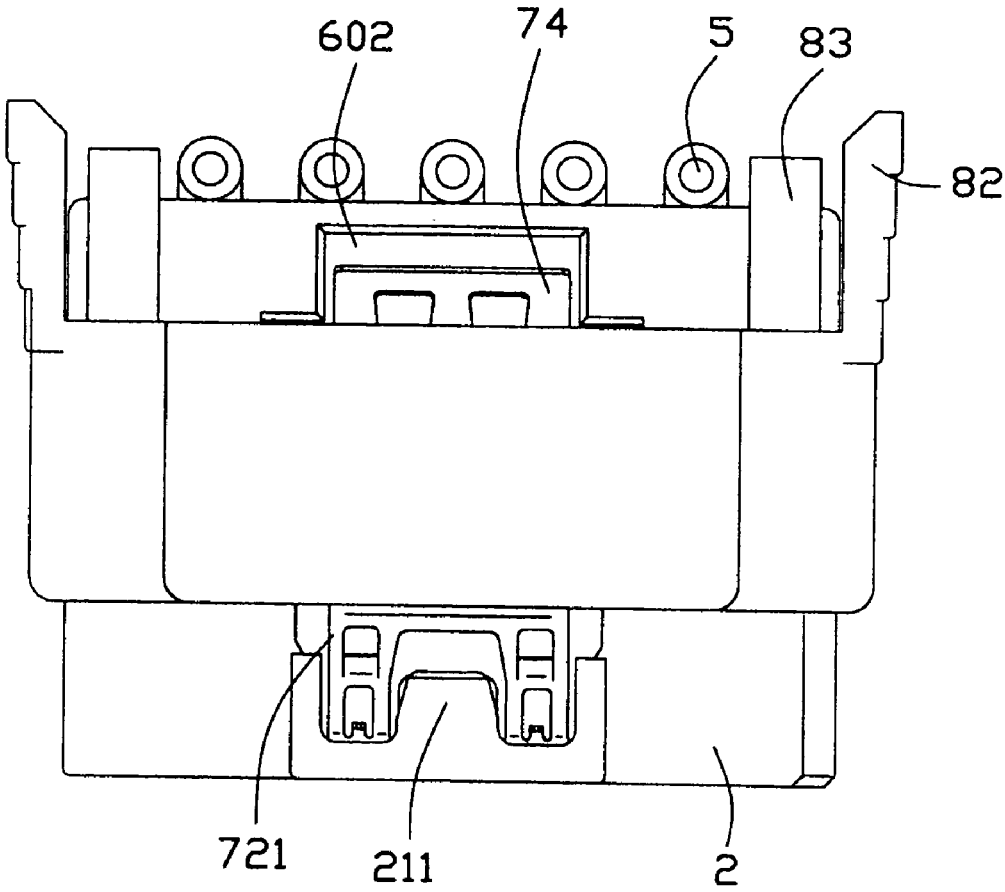
FIG. 6 is a top plan view of the cable end connector assembly shown in FIG. 4.
Figure 7:
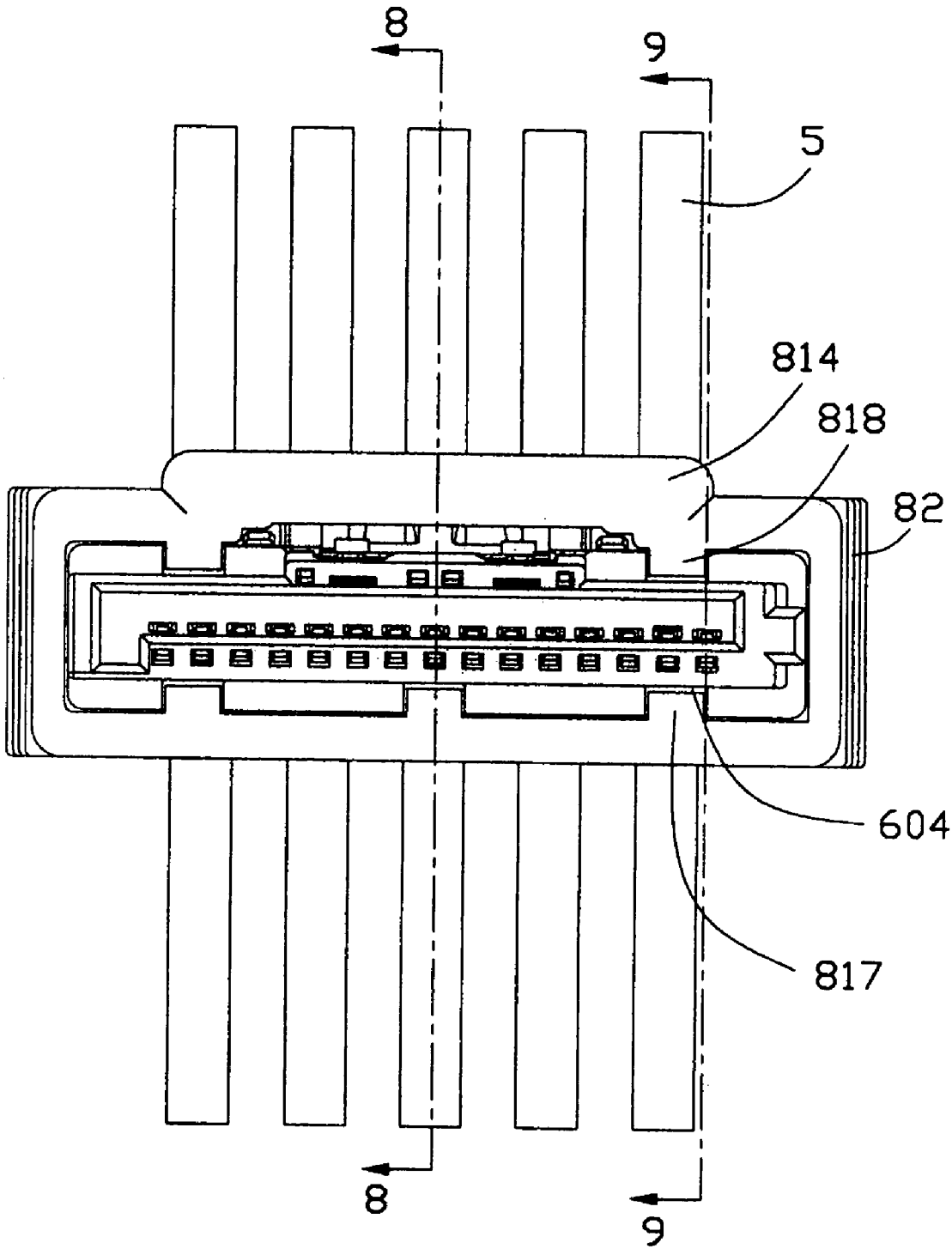
FIG. 7 is a front plan view of the cable end connector assembly shown in FIG. 4.
Figure 8:
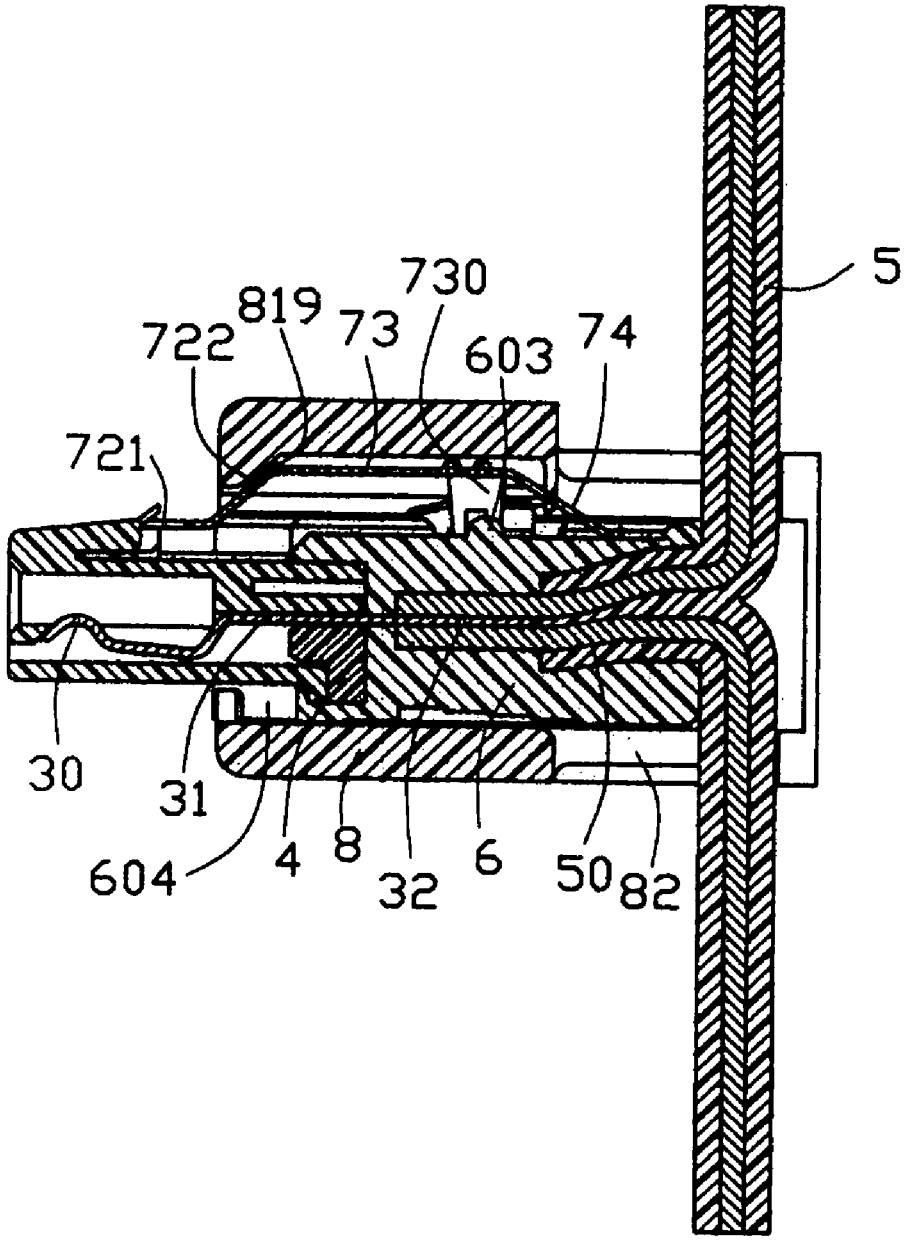
FIG. 8 is a cross-sectional view taken along line 8—8 of FIG. 7.
Figure 9:
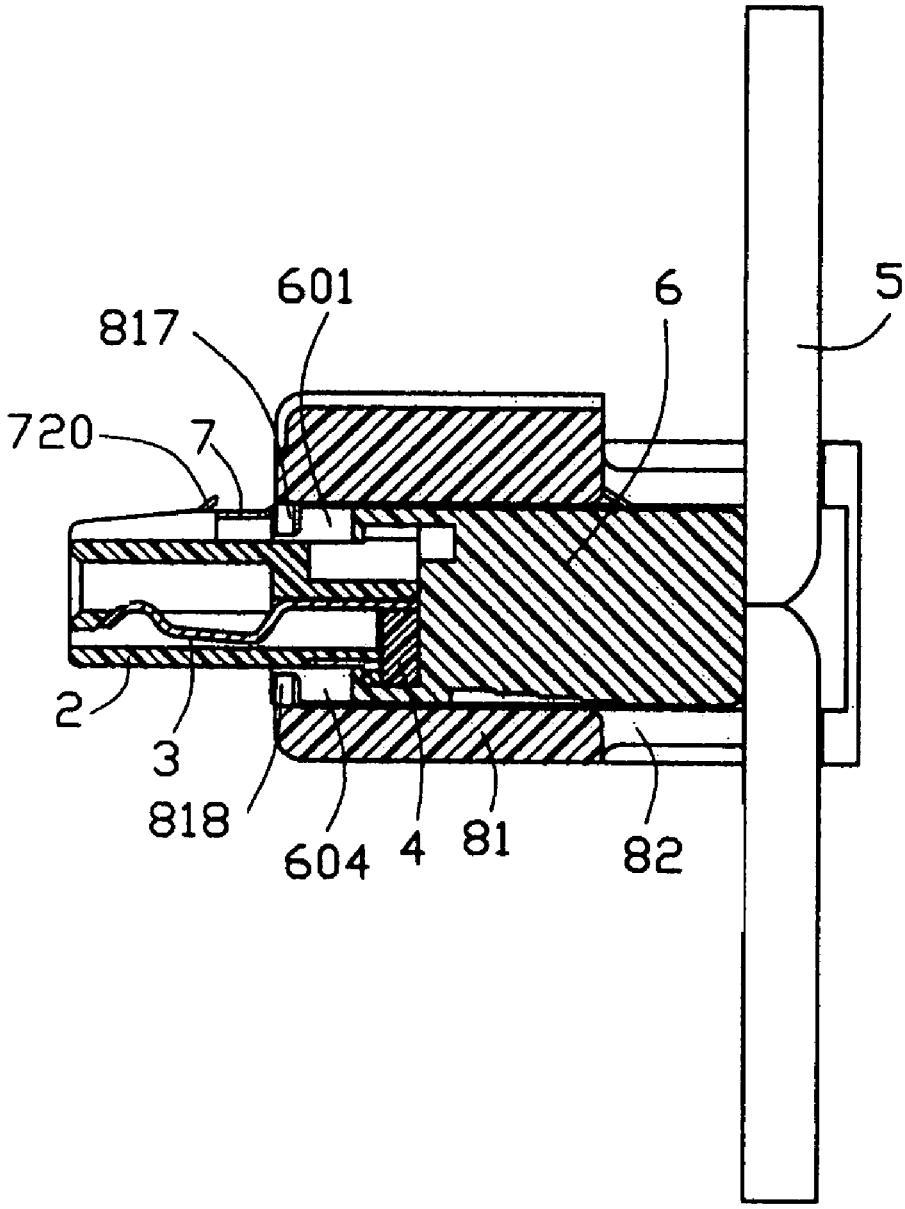
FIG. 9 is a cross-sectional view taken along line 9—9 of FIG. 7.

Referring to FIGS. 1–2 in conjunction with FIG. 6, the insulative housing 2 comprises an upper wall 21, a lower wall 22 opposite to the upper wall 21, and a pair of sidewalls 23 connecting with the upper wall 21 and the lower wall 22. A guiding projection 25 projects outwardly from one sidewall 23 for guiding a proper insertion of a complementary connector. An L-shaped receiving space 26 is defined between the upper and the lower walls 21, 22. A plurality of passageways 24 is defined through the lower walls 22 along a front-to-back direction. The upper wall 21 defines a depression 210 on an upper surface thereof. A flat portion 211 protrudes upwardly and rearwardly from a middle portion of a front flange of the upper wall 21 into the depression 210. A gap 212 is formed between the flat portion 211 and a bottom surface of the depression 210. The upper wall 21 defines a pair of first slots 213 at opposite inner sides of the depression 210, and a pair of second slots 214 and a pair of third slots 215 disposed at the middle portion and respectively in communication with the gap 212. At a rear portion of the insulative housing 2, a pair of wing portions 28 respectively extend rearwardly from opposite sides of the depression 210. Each wing portion 28 defines a cutout 280 in a rear portion thereof.

The contacts 3 are respectively disposed in the passageways 24 of the insulative housing 2. Each contact 3 comprises three contact portions 30 respectively exposed in the passageways 24 of the insulative housing 2, three retention portions 31 respectively extending rearwardly from the contact portions 30, and a common U-shaped tail portion 32.

The spacer 4 is mounted to a rear end of the insulative housing 2. The spacer 4 can prevent plastic from seeping into the passageways 24 of the insulative housing 2 during the molding process of the cover 6.

Each wire 5 comprises a conductor 50 for soldering to a tail portion 32 of a corresponding contact 3.

The cover 6 comprises a top wall 60, an opposite bottom wall 61, a pair of side walls 62 parallel extending between the top and the bottom walls 60, 61. A receiving cavity 64 is defined between the top and the bottom walls 60, 61 for receiving the rear end of the insulative housing 2. The top wall 60 defines a recess 602 in an upper surface thereof in a position corresponding to the depression 210 of the housing 2. A pair of passages 63 are defined at opposite sides of the recess 602 in communication with the receiving cavity 64. The top wall 60 comprises a holding bar 603 located between the two passages 63. A plurality of cutouts are defined at a front end of the cover 6 in the opposite top and bottom walls 60, 61. The top wall 60 defines a pair of first cutouts 601 at a front end thereof symmetrically disposed at outsides of the recess 602. The bottom wall 61 defines three second cutouts 604, two of which are in alignment with the pair of first cutouts 601 in a vertical direction and another one is disposed in a middle portion.

The locking member 7 is stamped and formed with a metallic plate and comprises a retaining portion 71, a locking portion 72 extending upwardly and rearwardly from the retaining portion 71, a pressing portion 73 extending rearwardly from the locking portion 72, and a supporting portion 74 extending rearwardly and downwardly from the pressing portion 73. The retaining portion 71 has a pair of side tabs 712 extending rearwardly from opposite ends thereof, a pair of snap tabs 711 extending rearwardly and upwardly from a middle portion of a front end thereof, a pair of positioning portions 713 extending forwardly from the front end, and a pair of curved portions 714 protruding opposite to the positioning portions 713. The locking portion 72 comprises a level portion 721 extending rearwardly from the retaining portion 71 and an oblique portion 722 extending rearwardly from the level section 721 at an inclination. The level portion 721 comprises a pair of latch portions 720 projecting upwardly and rearwardly therefrom and located close to the retaining portion 71. The pressing portion 73 comprises a pair of downwardly extending side beams 730 adjacent to the supporting portion 74. Each side beam 730 is stamped with a spring tab 731 extending outwardly therefrom.

The pulling device 8 is made of plastic material and comprises a body portion 81 and a handling portion 82. The body portion 81 is formed with an upper wall 811, an opposite lower wall 812 and a pair of sidewalls 813 extending between the upper and the lower walls 811, 812. The body portion 81 defines an opening 815 between the upper and the lower walls 811, 812. The upper wall 811 comprises a pair of first protrusions 817 at a front end thereof protruding toward the opening 815 and located in positions corresponding to the first cutouts 601 of the cover 6. The lower wall 812 forms three second protrusions 818 at a front end thereof protruding opposite to the first protrusions 817 and located in positions respectively corresponding to the second cutouts 604 of the cover 6. The upper wall 811 comprises a rectangular expanded portion 814 expanding outwardly in the vertical direction, so as to increase a vertical dimension of the opening 815. An acting portion 819 is formed at the front end of the upper wall 811 extending along an inner side of the expanded portion 814 between the two first protrusions 817. The acting portion 819 has a serrated oblique surface. Two pairs of latching portions 83 located at rear opposite ends of the body portion 81 respectively rearwardly extend from the upper wall 811 and the lower wall 812. Each latching portion 83 forms a hooked portion 830 at a distal end thereof. The handling portion 82 has a pair of opposite arm portions 820 respectively extending outwardly and rearwardly from the opposite sidewalls 813. Each arm portion 820 has a serrated exterior surface for facilitating handling.

Figure 3:
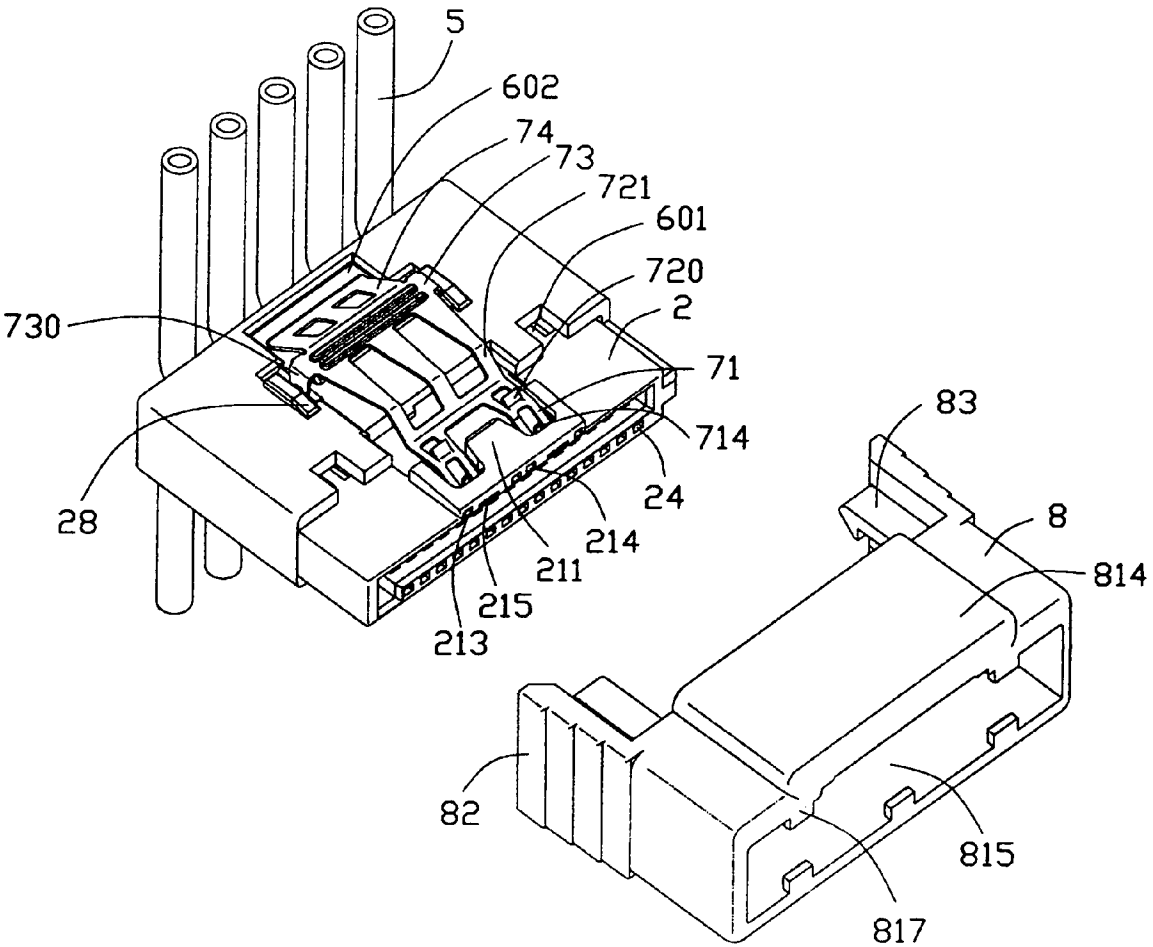
FIG. 3 is a partially assembled view of the cable end connector assembly shown in FIG. 1, but with a pulling device unassembled thereto.
Figure 4:
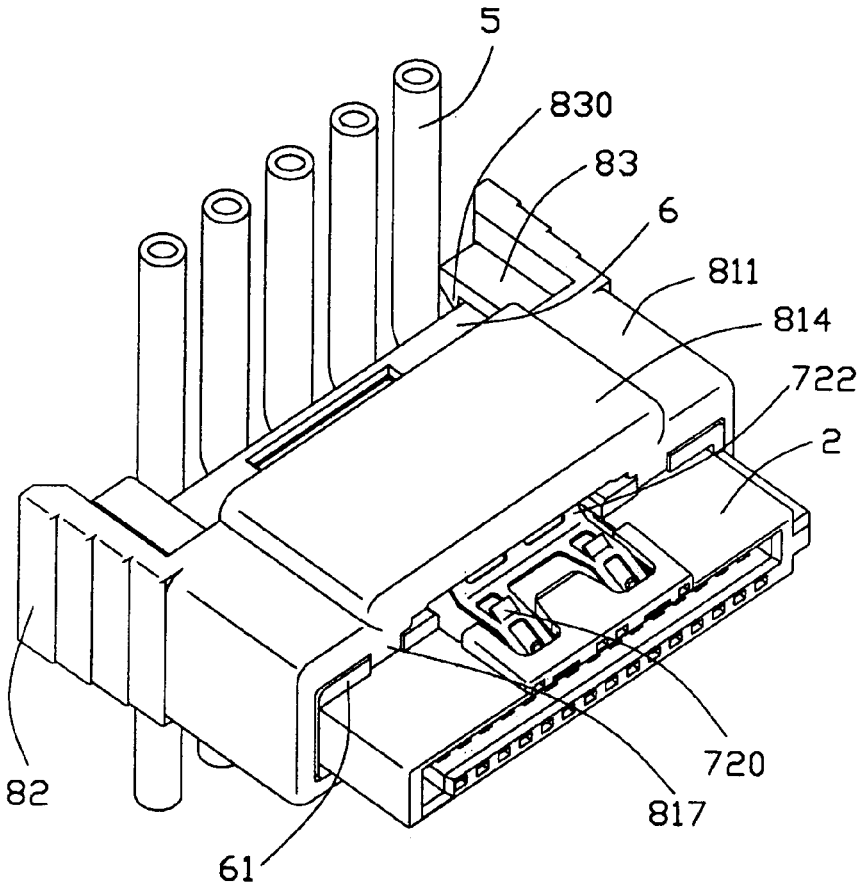
FIG. 4 is an assembled view of the cable end connector assembly shown in FIG. 2.
Figure 5:
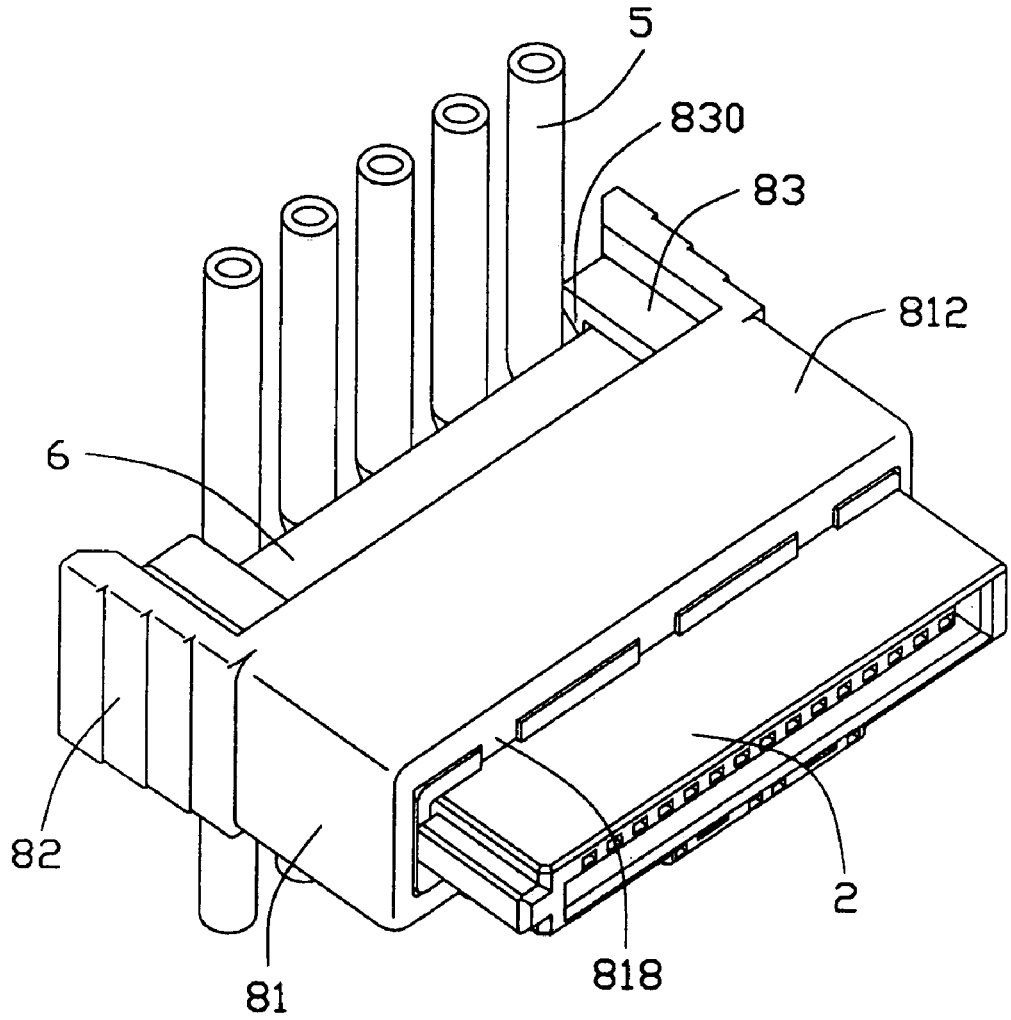
FIG. 5 is a bottom perspective view of FIG. 4.

Also referring to FIG. 3, in assembly, the contacts 3 are inserted into the housing 2 from the rear. The contact portions 30 of the contacts 3 are respectively exposed in the passageways 24 for electrically connecting with mating contacts of the complementary connector. The retention portions 31 of the contacts 3 are respectively interferentially engaged with opposite inner side surfaces of the corresponding passageways 24. The tail portions 32 are exposed beyond the rear end of the housing 2. Each tail portion 32 is soldered with two conductors 50 of the wires 5, which are respectively disposed on two opposite sides of the tail portion 32. The wires 5 are arranged in two groups and oppositely extend in a direction perpendicular to a mating direction of the cable end connector assembly 1. The spacer 4 is assembled to the rear end of the housing 2 to seal the passageways 24. The cover 6 is molded over the wing portions 28 of the housing 2 and joint portions of the contacts 3 and the wires 5. The wing portions 28 are partially exposed beyond the passages 63 of the cover 6. The locking member 7 is then assembled to the cover 6 and the housing 2 under a pressing force. The pair of side beams 730 of the locking member 7 are respectively inserted into the passages 63 of the cover 6 with the spring tabs 731 received in the cutouts 280 of the wing portions 28. The spring tabs 731 can slide in the cutouts 280 along the front-to-back direction. The retaining portion 71 of the locking member 7 is forwardly pushed, with the side tabs 712 received in the first slots 213. The positioning tabs 713 and the snap tabs 711 are pushed into the gap 212 and are respectively received in the third and the second slots 215, 214. A free end of the supporting portion 74 abuts against a bottom surface of the depression 602 of the cover 6.

Referring to FIGS. 4–9 and in conjunction with FIGS. 1–3, the pulling device 8 is assembled to the cover 6 with front portions of the housing 2 and the locking member 7 and a rear portion of the supporting portion 74 exposed outside. The pressing portion 73 is fittingly disposed within the opening 815 due to an increased vertical dimension created by the expanded portion 814. The oblique portion 722 of the locking member 7 is relatively close to the inclined surface of the acting portion 819 in the vertical direction. The hooked portions 830 of the latching portions 83 are latchingly engaged with a rear end 65 of the cover 6. The first protrusions 817 and the second protrusions 818 are respectively slideably received in the first and the second cutouts 601, 604. The arm portions 820 are respectively located at two opposite outsides of the cover 6, with rear ends thereof beyond a plane defined by the wires 5. When the hooked portion 830 of the latching portion 83 is latched with the rear end 65 of the cover 6, the pulling device 8 is in an original position (particularly shown in FIG. 9) where the pulling device 8 cannot forwardly move. When the protrusions 817, 818 of the pulling device 8 are rearwardly moved to abut against rear sides of the corresponding cutouts 601, 604 of the cover 6, the pulling device 8 is in a final position where the pulling device 8 cannot rearwardly move. Thus, the pulling device 8 is able to be restrictively movable between the original position and the final position along the front-to-back direction.

When the cable end connector assembly 1 is to be mated with the complementary connector in the front-to-back direction, a rearward pulling force is exerted on the arm portions 820 of the pulling device 8. The pulling device 8 is rearwardly moved from the original position thereof. The pulling force passes to the locking portion 72 of the locking member 7 through the engagement between the acting portion 819 and the oblique portion 722 of the locking portion 72. The oblique portion 722 is forced to downwardly and rearwardly move. The latch portions 720 of the locking portion 72 are forced to downwardly move a big enough distance correspondingly to realize the locking/unlocking between the cable end connector assembly 1 and the complementary connector easily. When the pulling device 8 is further rearwardly pulled to the final position thereof, the pulling force passes to the cover 6 via an engagement between the protrusions 817, 818 and the cutouts 601, 604 of the cover 6, thereby preventing further rearward pulling of the pulling device 8. The cable end connector assembly 1 is thus successfully separated from the complementary connector. When the pulling force is withdrawn, the oblique portion 722 of the locking member 7 will restore to an original station thereof. The pulling device 8 also resumes to its original position with the hooked portions 830 of the latching portions 83 latching with the rear end 65 of the cover to prevent farther forward movement thereof.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A cable end connector assembly, comprising:

an insulative housing;

a plurality of contacts disposed in the insulative housing;

a plurality of wires having conductors electrically connecting with corresponding contacts;

an insulative cover enclosing a rear end of the housing and joint portions of the conductors of the wires and the contacts;

a locking member being movably retained to the insulative housing, the locking member having a latch portion for loctcing with a complementary connector; and a pulling device comprising a longitudinal body portion engaging with the locking member and a handling portion rearwardly extending from the body portion;

wherein the pulling device comprises two pairs of latching portions rearwardly extending from opposite sides of each longitudinal end thereof, each latching portion having a hooked portion at a distal end thereof latchably engaging with a rear end of the cover.

2. The cable end connector assembly as claimed in claim 1, wherein the body portion of the pulling device forms an acting portion at a front end thereof for engaging with the locking member when the pulling device is rearwardly pulled.

3. The cable end connector assembly as claimed in claim 2, wherein the acting portion of the pulling device has a serrated oblique surface.

4. The cable end connector assembly as claimed in claim 2, wherein the locking member comprises an oblique portion, which is rearwardly and downwardly pressed by the acting portion of the pulling device when the pulling device is rearwardly pulled.

5. The cable end connector assembly as claimed in claim 2, wherein the body portion of the pulling device defines an opening therethrough partially receiving the cover and the locking member therein, with a front end of the locking member exposed outside, and wherein the acting portion of the pulling device is formed on an upper inner side of the opening.

6. The cable end connector assembly as claimed in claim 5, wherein the cover defines a plurality of cutouts in opposite sides at a front end thereof, and wherein the body portion of the pulling device forms a plurality of protrusions on two opposite sides of the opening movably received in corresponding cutouts.

7. The cable end connector assembly as claimed in claim 6, wherein each of the protrusions protrudes into the opening.

8. The cable end connector assembly as claimed in claim 1, wherein the body portion of the pulling device comprises an expanded portion in a middle portion thereof for providing enough space to receive the locking member therein.

9. The cable end connector assembly as claimed in claim 1, wherein the housing comprises a plurality of passageways therethrough, and wherein each contact comprises three contact portions respectively exposed in the passageways, three retention portions respectively engaged with inner side surfaces of the passageways, and a common tail portion extending beyond a rear end of the insulative housing.

10. The cable end connector assembly as claimed in claim 9, wherein the tail portion of each contact is terminated with two oppositely extending wires.

11. The cable end connector assembly as claimed in claim 1, wherein the locking member comprises a retaining portion at a front end thereof secured with the insulative housing, a supporting portion at a rear end thereof abutting against an upper face of the cover, and a pressing portion between the retaining portion and the supporting portion, and wherein the oblique portion connects with the pressing portion and the latch portion is located close to the retaining portion.

12. The cable end connector assembly as claimed in claim 11, wherein the insulative housing comprises a pair of wing portions extending rearwardly from a rear end thereof, each wing portion defining a cutout, and wherein the pressing portion of the locking member comprises a pair of side beams extending vertically from opposite ends thereof, each side beam forming a spring tab engaged in the cutout of a corresponding wing portion.

13. The cable end connector assembly as claimed in claim 11, wherein the insulative housing defines a gap receiving a middle portion of the retaining portion of the locking member.

14. The cable end connector assembly as claimed in claim 1, further comprising a spacer assembled to a rear end of the insulative housing for preventing plastic from seeping into the housing during the molding of the cover.

15. A cable end cormector assembly, comprising:

an insulative housing;

a plurality of contacts disposed in the insulative housing;

a plurality of wires having conductors electrically cormecting with corresponding contacts;

an insulative cover enclosing a rear end of the housing and joint portions of the conductors of the wires and the contacts;

a locking member being movably retained to the insulative housing, the locking member having a latch portion for locking with a complementary connector; and a moveable pulling device protectively covering the locking member and comprising an acting portion actuating the locking member to be unlatched from the complementary connector;

wherein the moveable pulling device comprises two pairs of latching portions rearwardly extending from opposite sides of each longitudinal end thereof, each latching portion having a hooked portion at a distal end thereof latchably engaging with a rear end of the cover.

16. A cable end connector assembly, comprising:

an insulative housing;

a plurality of contacts disposed in the insulative housing;

a plurality of wires having conductors electrically cormecting with corresponding contacts;

an insulative cover enclosing a rear end of the housing and joint portions of the conductors of the wires and the contacts;

a locking member being movably retained to the insulative housing, the locking member having a latch portion for locking with a complementary connector; and a pulling device attached to at least one of said cover and said housing, said pull device being moveable along a front-to-back direction and thus being capable of actuating the locking member to be deflected in a vertical direction, perpendicular to said front-to-back direction, for being unlatched from the complementary connector;

wherein the pulling device comprises two pairs of latching portions rearwardly extending from opposite sides of each longitudinal end thereof, each latching portion having a hooked portion at a distal end thereof latchably engaging with a rear end of the cover.

* * * * *